US007585005B1

(12) United States Patent
Cote et al.

(10) Patent No.: US 7,585,005 B1
(45) Date of Patent: Sep. 8, 2009

(54) LOCKING MECHANISM FOR SECURING BEZELS

(75) Inventors: Gerald J. Cote, Upton, MA (US); W. Brian Cunningham, Westborough, MA (US); Albert F. Beinor, Jr., Sutton, MA (US); C. Ilhan Gundogan, Lexington, MA (US)

(73) Assignee: EMC Corporation, Hopkinton, MA (US)

( * ) Notice: Subject to any disclaimer, the term of this patent is extended or adjusted under 35 U.S.C. 154(b) by 256 days.

(21) Appl. No.: 11/387,426

(22) Filed: Mar. 23, 2006

(51) Int. Cl.
*E05C 9/10* (2006.01)
*E05C 9/00* (2006.01)

(52) U.S. Cl. ..... 292/38; 292/32; 292/37; 292/42; 292/137; 292/163; 292/169; 292/171; 292/175; 292/DIG. 37; 312/223.2; 312/265.5

(58) Field of Classification Search ..... 292/32, 292/33, 37, 38, 42, 137, 163, 169, 171, 175, 292/DIG. 37, DIG. 38, DIG. 20, DIG. 47; 312/265.5, 223.2
See application file for complete search history.

(56) References Cited

U.S. PATENT DOCUMENTS

| | | | | |
|---|---|---|---|---|
| 4,999,459 | A | 3/1991 | Smith et al. | |
| 5,139,291 | A * | 8/1992 | Schultz | 292/42 |
| 5,365,285 | A | 11/1994 | Kizuya et al. | |
| 5,992,907 | A * | 11/1999 | Sheldon et al. | 292/34 |
| 6,239,359 | B1 | 5/2001 | Lilienthal et al. | |
| 6,515,871 | B1 | 2/2003 | Stark et al. | |
| 6,544,047 | B2 | 4/2003 | Moore | |
| 6,563,042 | B2 | 5/2003 | Barabash | |
| 6,590,848 | B1 | 7/2003 | Chen | |
| 6,607,221 | B1 * | 8/2003 | Elliott | 292/33 |
| 6,608,251 | B1 | 8/2003 | Nurmi | |
| 6,623,051 | B2 * | 9/2003 | Bonora | 292/330 |
| 6,648,149 | B2 | 11/2003 | Robertson | |
| 6,671,179 | B2 | 12/2003 | Chen | |
| 7,001,217 | B2 | 2/2006 | Bright et al. | |
| 2001/0003406 | A1 | 6/2001 | Bertolami | |
| 2002/0017838 | A1 | 2/2002 | Roesner et al. | |
| 2002/0064349 | A1 | 5/2002 | Ngo et al. | |
| 2005/0264142 | A1 | 12/2005 | Cunningham et al. | |

* cited by examiner

*Primary Examiner*—Carlos Lugo
(74) *Attorney, Agent, or Firm*—Guerin & Rodriguez, LLP; Michael A. Rodriguez

(57) ABSTRACT

A bezel has a locking mechanism that allows bezel designs to locate the bezel lock anywhere along the length of the bezel. The bezel includes a bezel frame, a first plunger mechanism, and a second plunger mechanism. Each plunger mechanism is moveably coupled to the bezel frame at opposite ends of the bezel frame and is movable between a latched position and an unlatched position. A first rod is attached to the first plunger mechanism and a second rod is attached to the second plunger mechanism. A cam lock is positioned between the first rod and the second rod. The cam lock is movable between a locked position and an unlocked position, wherein the cam lock restricts movement of both rods sufficiently to stop the plunger mechanisms from moving from the latched position to the unlatched position when the cam lock is in the locked position.

18 Claims, 8 Drawing Sheets

LOCKING MECHANISM FOR SECURING BEZELS

FIELD OF THE INVENTION

The present invention relates generally to bezels for electronics enclosures. More particularly, the present invention relates to locking mechanisms for securing bezels to mounting structures.

BACKGROUND

Electronics equipment is often mounted in racks or other such structures. Bezels attached to the mounting structures aesthetically protect the front-facing portion of the equipment and allow technical personnel access to the equipment for maintenance and repair. The mounting structure can include vertical rails with catches to which the bezel is mounted. Bezels typically have two latch mechanisms, on opposite ends of the bezel, that attach to the catches on the vertical rails. A lock is often used to prevent unauthorized removal of the bezel from the rails. The lock prevents personnel from removing the bezel from the mounting structure.

For aesthetic or functional reasons, some locks are located midway along the length of the bezel. Other locks have been displaced to one side of the bezel. In general, the particular location of the lock requires a particular mechanical solution for locking the bezel latches. A solution specific to a centrally located lock is typically inapplicable to bezels with a lock displaced to one side. Moreover, many solutions require numerous pieces of separate mechanical fasteners, such as screws, which can complicate assembly of the bezel.

SUMMARY

In one aspect, the invention features a bezel comprising a bezel frame and a first plunger mechanism and a second plunger mechanism moveably coupled to the bezel frame at opposite ends of the bezel frame. Each plunger mechanism is movable between a latched position and an unlatched position. A first rod is coupled to the first plunger mechanism and a second rod is coupled to the second plunger mechanism. A cam lock, positioned between the first rod and the second rod, is movable between a locked position and an unlocked position. The cam lock restricts movement of both rods sufficiently to stop the plunger mechanisms from moving to the unlatched position when the cam lock is in the locked position.

In another aspect, the invention features a bezel comprising a bezel frame and first and second means, disposed at opposite ends of the bezel frame, for latching the bezel frame to a mounting structure. Each latching means is movable between a latched position and an unlatched position. A lock means is coupled to the bezel frame at a location between the first and second latching means. The lock means is movable between a locked position and an unlocked position. The bezel also includes first means for coupling the first latching means to the lock means, and a second means for coupling the second latching means to the lock means, wherein the lock means simultaneously restricts movement of the first and second coupling means sufficiently to stop each latching means from moving from the latched position to the unlatched position when the lock means is in the locked position.

In still another aspect, the invention features an electronics equipment enclosure comprising a housing with a mounting structure and a bezel. The bezel includes a bezel frame and a first plunger mechanism and a second plunger mechanism moveably coupled to the bezel frame and to the mounting structure at opposite ends of the bezel frame. Each plunger mechanism is movable between a latched position and an unlatched position. A first rod is coupled to the first plunger mechanism and a second rod is coupled to the second plunger mechanism. A cam lock, positioned between the first rod and the second rod, is movable between a locked position and an unlocked position. The cam lock restricts movement of both rods sufficiently to stop the plunger mechanisms from moving from the latched position to the unlatched position when the cam lock is in the locked position.

BRIEF DESCRIPTION OF THE DRAWINGS

The above and further advantages of this invention may be better understood by referring to the following description in conjunction with the accompanying drawings, in which like numerals indicate like structural elements and features in the various figures. The drawings are not meant to limit the scope of the invention. For clarity, not every element may be labeled in every figure. The drawings are not necessarily to scale, emphasis instead being placed upon illustrating the principles of the invention.

DETAILED DESCRIPTION

Bezels embodying the present invention have a locking mechanism that provides bezel designers with flexibility with respect to where along the length of the bezel to locate the bezel lock (e.g., in the center or displaced to one side). Moreover, such bezels have plunger mechanisms—for latching to a mounting structure, e.g., of an electronics enclosure, such as a data storage enclosure, or of a rack—that require no separate mechanical screws, bolts, washers, or nuts, thus simplifying the assembly of the bezel. In brief overview, the plunger mechanisms are at opposite ends of the bezel. A single locking mechanism prevents personnel from operating the plunger mechanisms to remove the bezel from the mounting structure. When locked, however, the locking mechanism does not prevent the bezel from being attached to the mounting structure. It is a feature of the present invention that the locking mechanism may be located centrally on the bezel or may be located near a side of the bezel.

Figure 1:
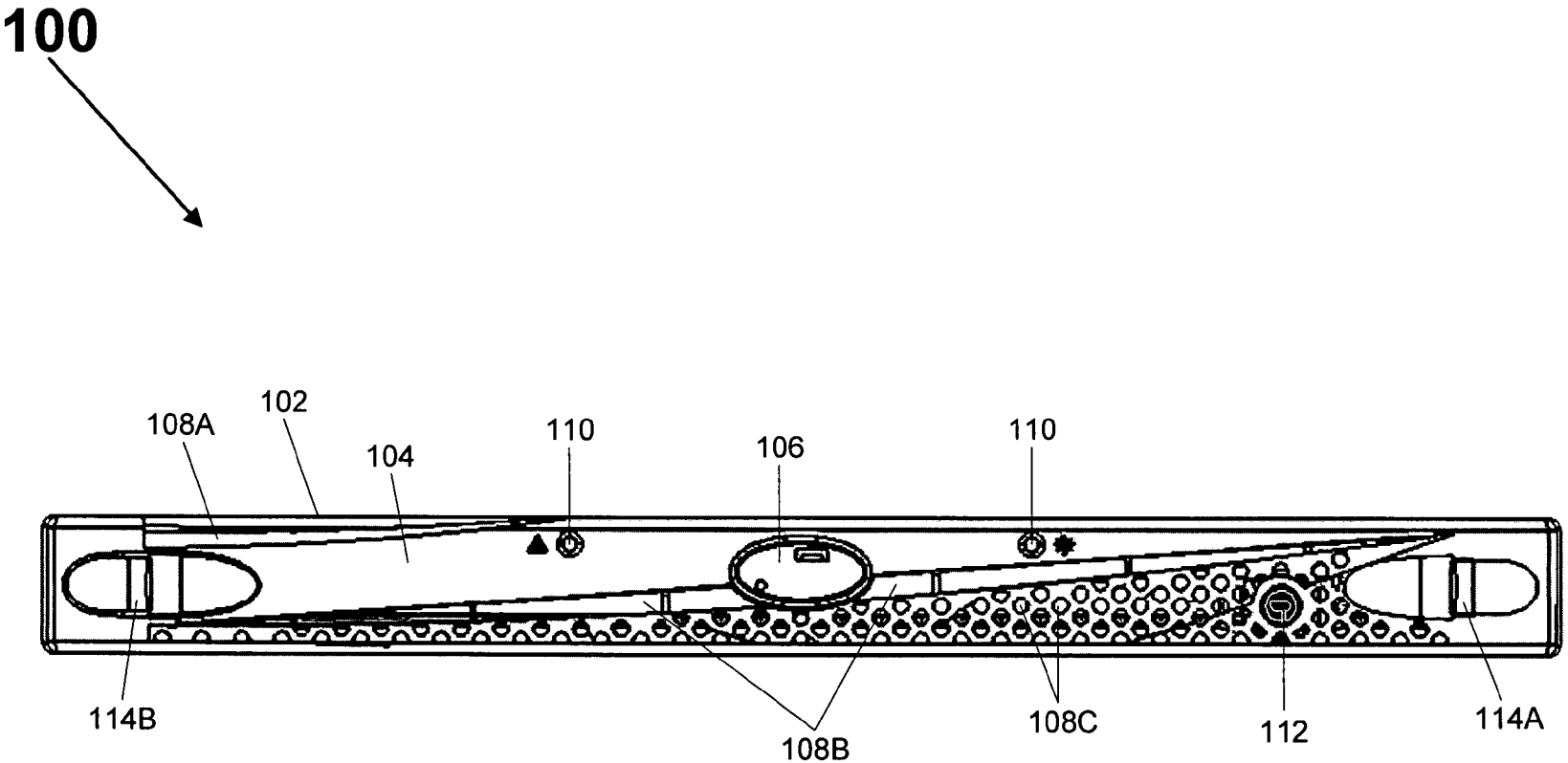
FIG. 1 illustrates the front side of a bezel constructed in accordance with the principles of the present invention.

FIG. 1 illustrates the front side of a bezel 100 constructed in accordance with the principles of the present invention. The front side of the bezel 100, also called a front panel or faceplate, faces away from the components within the electronics enclosure and is visible to personnel. The other (rear)

side of the bezel 100 faces the internal components of the electronics enclosure and is described below in connection with FIG. 2. The bezel 100 includes a bezel frame 102 of a generally rectangular shape. The bezel frame 102 is made, for example, by molding plastic material into the illustrated shape.

The outer surface 104 includes a badge 106 that can include any variety of information including, for example, the manufacturer's name, the product name or a logo. Airflow openings in the outer surface 104 provide a means to draw a cooling airflow through the bezel frame 102 and into the electronics enclosure. The airflow openings (generally, 108) include a horizontal opening 108A, distinctive sloped openings 108B, and numerous smaller circular openings 108C. Additional openings 110 accept light pipes that conduct light from status lights, such as emitting diodes (LEDs), mounted inside the electronics enclosure. Other embodiments have fewer or more airflow openings 108 and light pipe openings 110 than those shown. In other embodiments, the size, position and orientation of the openings 108, 110 in the bezel frame 102 are different.

A key port 112 of a locking mechanism is provided along the outer surface 104 to accept a key for locking or unlocking the bezel 100 from the mounting structure, as described herein. A pair of buttons 114A, 114B protrudes horizontally through openings in the outer surface 104 of the bezel frame 102. Personnel depress both buttons 114A, 114B to remove the bezel 100 from the equipment mounting structure when the bezel 100 is unlocked. When the bezel is locked, the buttons 114A, 114B will not depress sufficiently to allow removal of the bezel 100 from the equipment mounting structure. In preferred embodiments, the buttons 114A, 114B do not need to be depressed to mount the bezel 100.

Figure 2:
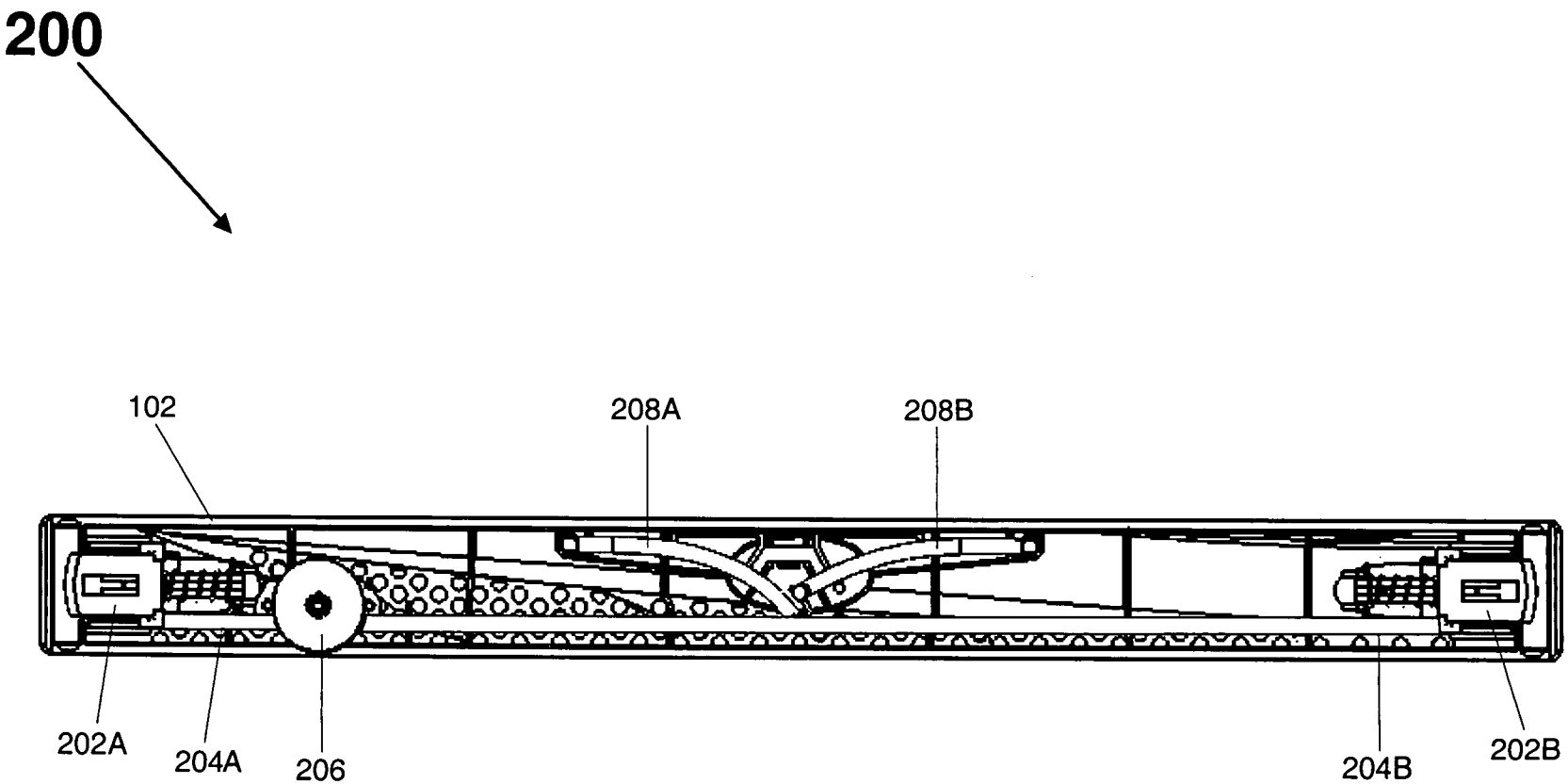
FIG. 2 is a back view of the bezel illustrated in FIG. 1.
Figure 3:
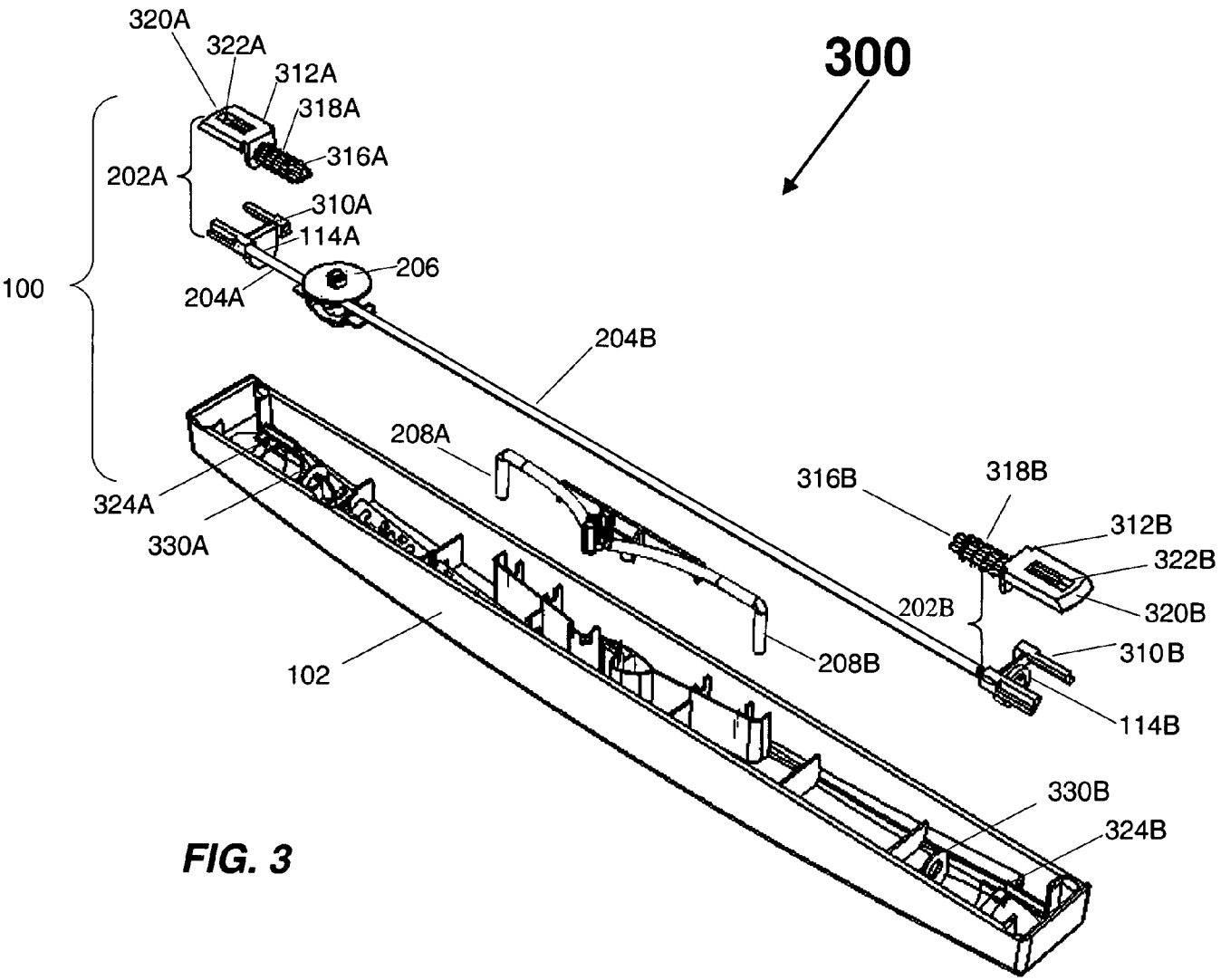
FIG. 3 is an exploded view of the bezel illustrated in FIG. 1.

Referring together to FIG. 2 and to FIG. 3, FIG. 2 shows a back view 200 of the bezel 100, and FIG. 3 shows an exploded view 300 of the bezel 100. The bezel can have an EMI shield (not shown) attached to the back of the bezel frame. EMI shields are known in the art and are not discussed in detail herein. The bezel 100 includes a first plunger mechanism 202A and a second plunger mechanism 202B (generally 202), a first rod 204A, a second rod 204B, a cam lock 206, first light pipe 208A, and a second light pipe 208B. The cam lock 206 is attached to the back of the bezel frame 102. The plunger mechanisms 202 are movably attached at opposite ends of the bezel frame 102 and are movable between a latched position and an unlatched position, as explained herein.

Each plunger mechanism 202A, 202B includes, respectively, a button portion 310A, 310B and a latch portion 312A, 312B. Each button portion 310A, 310B includes, respectively, a button 114A, 114B that protrudes through openings 540 (see FIG. 5) in the outer surface 104 of the bezel frame 102 as explained above. Each latch portion 312A, 312B includes a post 316A, 316B, a supporting a spring coil 318A, 318B, and a lip 320A, 320B. A keyhole-shaped opening 322A, 322B in the lip 320A, 320B of the latch portion 312A, 312B accepts a pedestal 324A, 324B extending from the back surface of the bezel frame 102. The post 316A, 316B is inserted through an opening in a rib 330A, 330B. The spring coil 318A, 318B is disposed around the post 316A, 316B and between the lip 320A, 320B and the post 316A, 318B such that the spring coil 318A, 318B is compressed when the latch portion 312A, 312B slides toward the rib 330A, 330B. Biasing mechanisms other than the spring coil 318A, 318B may be advantageously used for the same purpose, as described herein, of exerting a force on the latch portion 312A, 312B tending to urge the latch portion 312A, 312B to the latched position.

Figure 4:
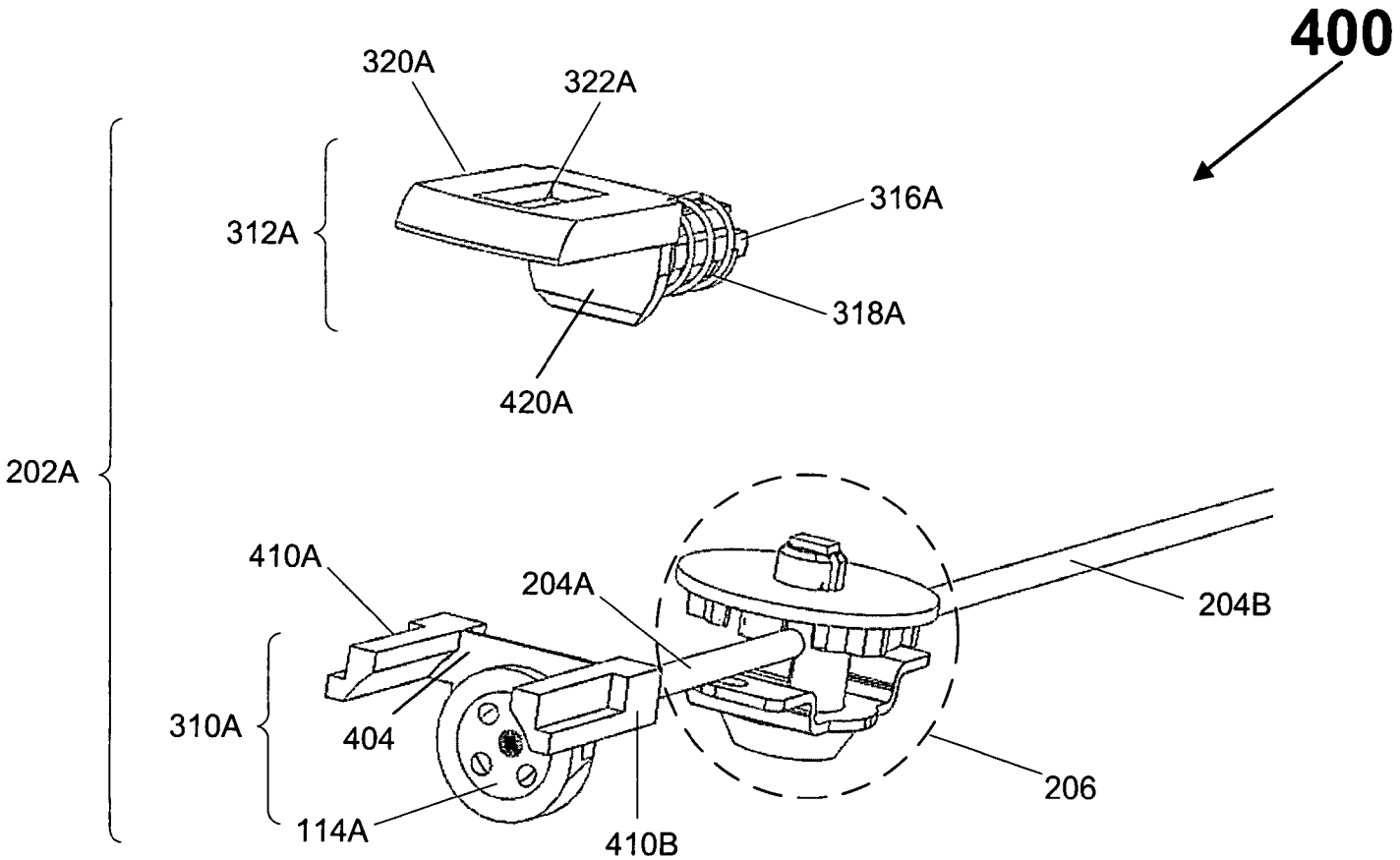
FIG. 4 is a partial, exploded view of the bezel illustrated in FIG. 1, illustrating a cam lock, a first rod, a second rod, a button portion, and a latch portion.
Figure 5:
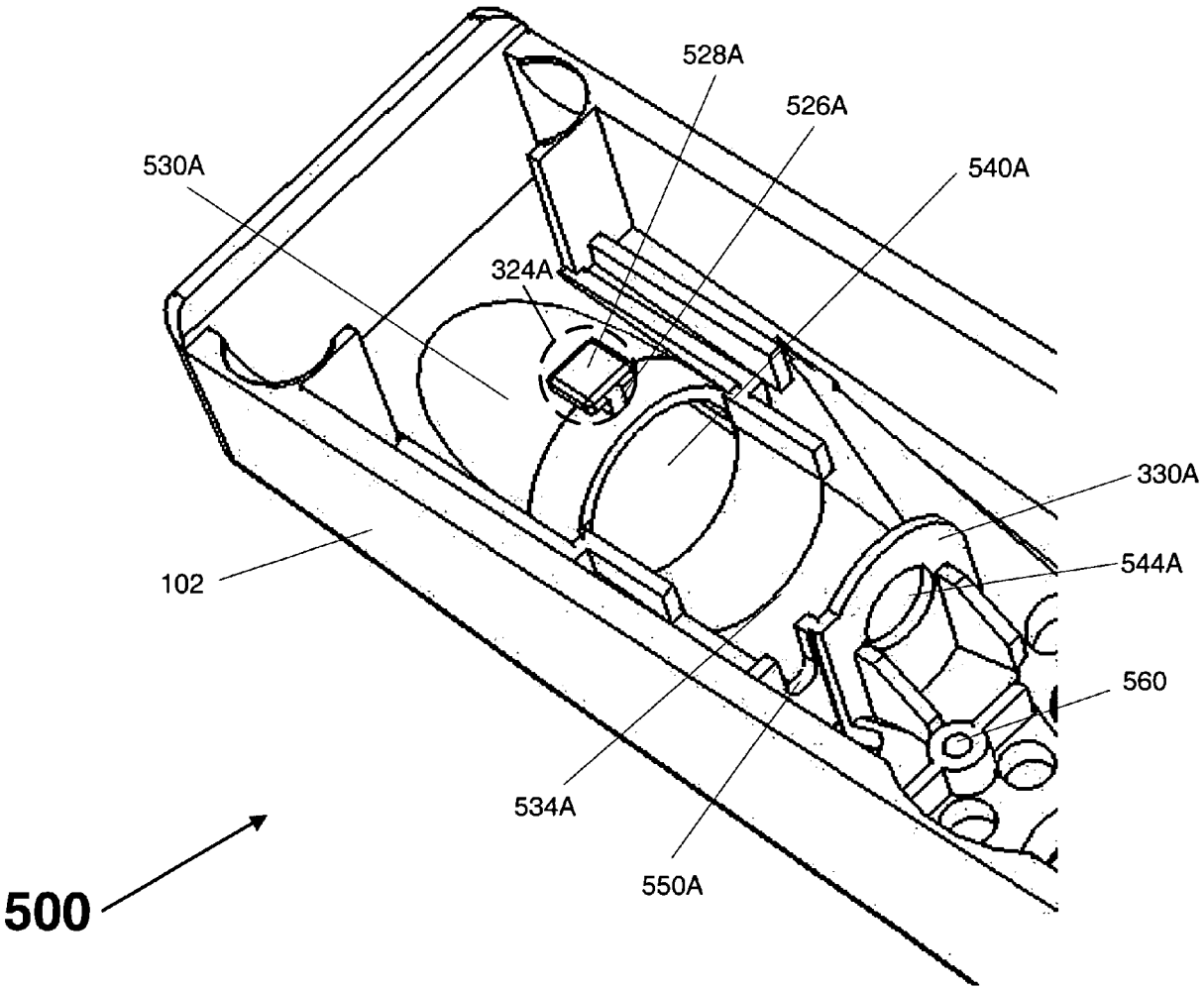
FIG. 5 is a partial, perspective view of the bezel frame of the bezel illustrated in FIG. 1.

FIG. 4 and FIG. 5 are referred to herein in some detail to explain the operation of the first plunger mechanism 202A. It should be understood that the second plunger mechanism 202B is constructed and functions in an analogous manner. FIG. 4 shows an embodiment of the plunger mechanism 202A, including the button portion 310A and the latch portion 312A. The button portion 310A includes the button 114A, a crossbeam 404 at the periphery of the button 114A, and a pair of rod receptacles 410A, 410B at opposite ends of the crossbeam 404, extending generally perpendicular to the button 114A. Although only one of the rod receptacles 410A, 410B couples to a rod, having two such receptacles enables the same button component to be used on either end of the bezel 102. In FIG. 4, an opening in the rod receptacle 410B receives one end of the first rod 204*a*; the other rod receptacle 410A is unused. The other end of the first rod 204*a* extends to the cam lock 206. Similarly, a rod receptacle of the button 114B (not shown) receives one end of the second rod 204B. The other end of the second rod 204B extends to the cam lock 206.

FIG. 5 shows a perspective view 500 of a portion of the bezel frame 102, including the pedestal 324A and the rib 330A. It should be understood that the other end of the bezel frame is similarly constructed and functions in an analogous manner. The pedestal 324A includes a stem portion 526A, which extends from an inwardly curved back surface 530A of the bezel frame 120, and a rectangular-shaped top portion 528A. The inwardly curved back surface 530A defines the opening 540A.

Adjacent the opening 540A is a curved button channel 534A, sized to receive the button 114A when pressed inwardly to unlatch the first plunger mechanism 202A. Opposite the opening 540A is the rib 330A. The rib 330A has an opening 544A therein for receiving the post 316A of the first plunger mechanism 312A. The diameter of the opening 544A is smaller than the diameter of the spring coil 318A so that the spring coil 318A pushes against the rib 330A when the post 316A enters the opening 544A. Adjacent the opening 544A is a notch 550A.

The button portion 310A is disposed in an operative position at the opening 540A, with the button 114A facing outwards through the opening 540A and the open ends of the rod receptacles 410A, 410B facing inwards toward the center of the bezel. The latch portion 312A sits atop the button portion 310A, with the lip portion 320 abutting the edges of the crossbeam 404 and rod receptacles 410A, 410B and with the button seat 420A abutting the button 114A in the button channel 534A.

The first rod 204A is inserted into the rod receptacle 410B of the button portion 310A so that the first rod 204A moves with the button portion 310A. In alternate embodiments, the first rod 204A could be attached to the button portion 310A by being manufactured as one contiguous piece with the button portion 310A. The first rod 204A is disposed in one or more U-shaped notches 550A in the bezel frame 102. The U-shaped notch 550A guides the first rod 204A as it moves back and forth as explained below.

To secure the latch portion 312A to the bezel frame 102, the post 316A enters the opening 544A and the spring coil 318A compresses until the rectangular-shaped top 528A of the pedestal 324A can enter the slot of the keyhole-shaped opening 322A of the latch portion 312A. After the rectangular-shaped top 528A enters the slot, the force of the spring coil 318A is released, causing the rectangular-shaped top portion 528A slides to the narrow end of the keyhole-opening 322A. In this manner, the latch portion 312A is slidably attached to the bezel frame 102. When the latch portion 312A is slidably attached, the button portion 310A is disposed between the latch portion 312A and the bezel frame 102. The coupling of the plunger mechanism 202A to the bezel frame 102 thus can be accomplished without the use of mechanical hardware fasteners, such as screws, bolts, nuts, and washers.

The latch portion 312A can be removed from the bezel frame 102 by pushing the latch portion 312A toward the rib 330A until the rectangular-shaped top portion 528A is disposed in the broad end of the keyhole-opening 322A, pulling the latch portion 312A away from the bezel frame 102, and then sliding the post 316A out of the opening in the rib 330A.

The bezel 100 can be unlatched from an enclosure to which it is latched by simultaneously depressing both buttons 114A, 114B while the bezel 100 is unlocked. As described herein, the buttons 114 cannot be depressed a sufficient distance to unlatch the bezel 100 when the bezel 100 is locked. When the cam lock 206 is in an unlocked position and the button 114A is pressed (i.e., pushed toward the cam lock 206), the button portion 310A and the first rod 204A are thrust toward the cam lock 206. The button portion 310A is in contact with the latch portion 312A and thrusts the latch portion 312A toward the cam lock 206, compressing the spring coil 318A. When the button portion 310A is fully depressed, the first rod 204 is placed in contact with the cam portion 620 (see FIG. 6) of the cam lock 206, preventing the button portion 310A and the latch portion 312A from moving further.

When the latch portion 312A has been thrust toward the cam lock 206, the broad end of the lip 320A disengages from the mounting structure of an enclosure (not shown), allowing the bezel 100 to be removed (i.e., unlatched) from the mounting structure. However, the contact of the first rod 204A with the cam portion 620 prevents the latch portion 312A from being thrust, by the button portion 310A, a sufficient distance to position the broad end of the keyhole opening 322A over the pedestal 324A on the bezel frame 102. Thus, the contact of the first rod 204A prevents the button portion 310A from being pushed so far that the latch portion 312A detaches from the bezel frame 102. In other words, fully depressing the button 114A moves the latch portion 312A in position to allow the bezel 100 to be unlatched from an enclosure, but does not move the latch portion 312A so far as to allow it to be removed from the bezel frame 102.

To remove the latch portion 312A from the bezel 100, the bezel 100 is first unlatched from an enclosure and then pressure is applied directly on the latch portion 312A to move it further so that the broad end of the keyhole opening 322A is over the pedestal 324A on the bezel frame 102, allowing the latch portion 312A to be removed. If the button 114A is released, the spring coil 318A decompresses, pushing the latch portion 312A and button portion 310A back to their resting positions. When the cam lock 206 is in a locked position, the cam lock 206 prevents the first rod 204A from advancing, which in turn prevents both the button portion 310A and latch portion 312A from advancing.

Figure 6:
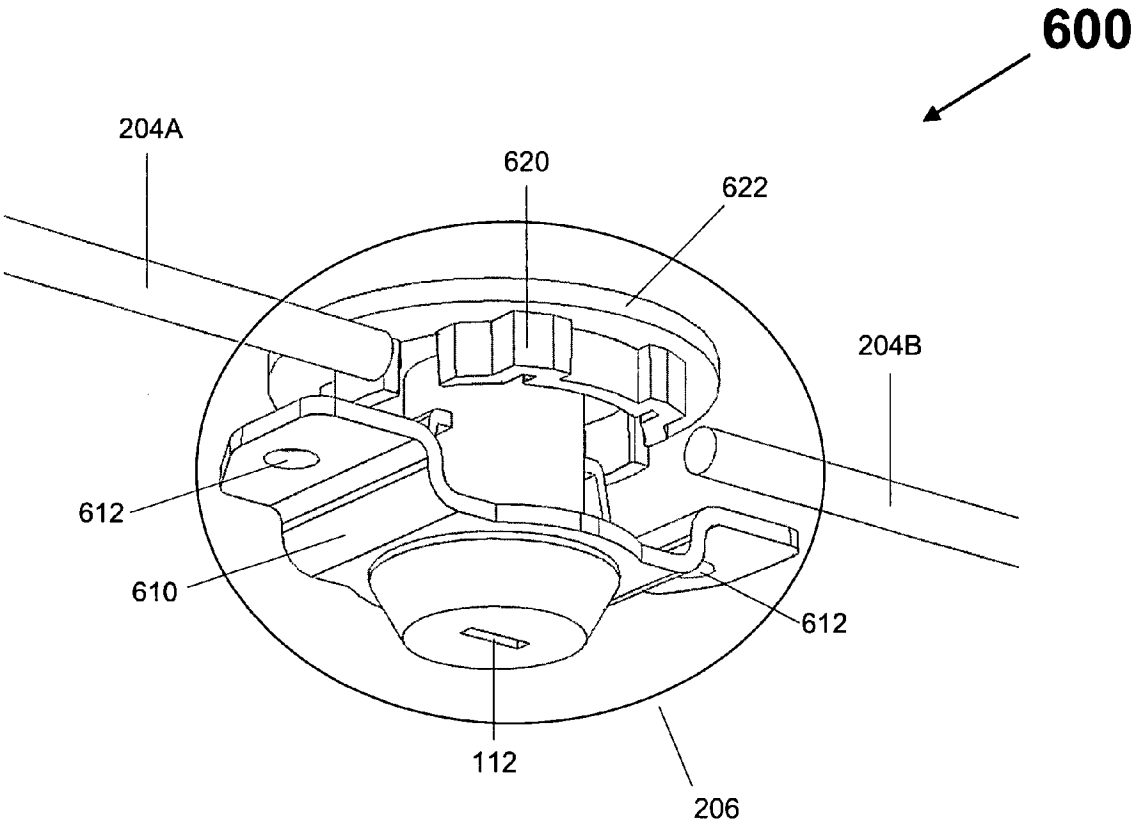
FIG. 6 is a partial, perspective view of the bezel of FIG. 1, illustrating the cam lock, a partial view of the first rod, and a partial view of the second rod.

FIG. 6 shows an embodiment of the cam lock 206 including the key port 112, a mounting plate 610 with two openings 612 to receive attachment screws (not shown), a cam portion 620, and a circular cam cover 622. The key port 112 accepts a key for locking or unlocking the bezel 100. The mounting plate 610 is used to secure the key port 112 and the cam lock 206 to the bezel frame 102 by aligning the two openings 612 with holes 560 (see FIG. 5) in the bezel frame 102 and securing the mounting plate 610 with screws (not shown) through the openings 612 and into the holes 560. The ends of the rods 204A, 204B closely approach the cam portion 620. The cam cover 622 prevents the ends of the rods 204A, 204B from moving away from the cam portion 620.

Figure 7:
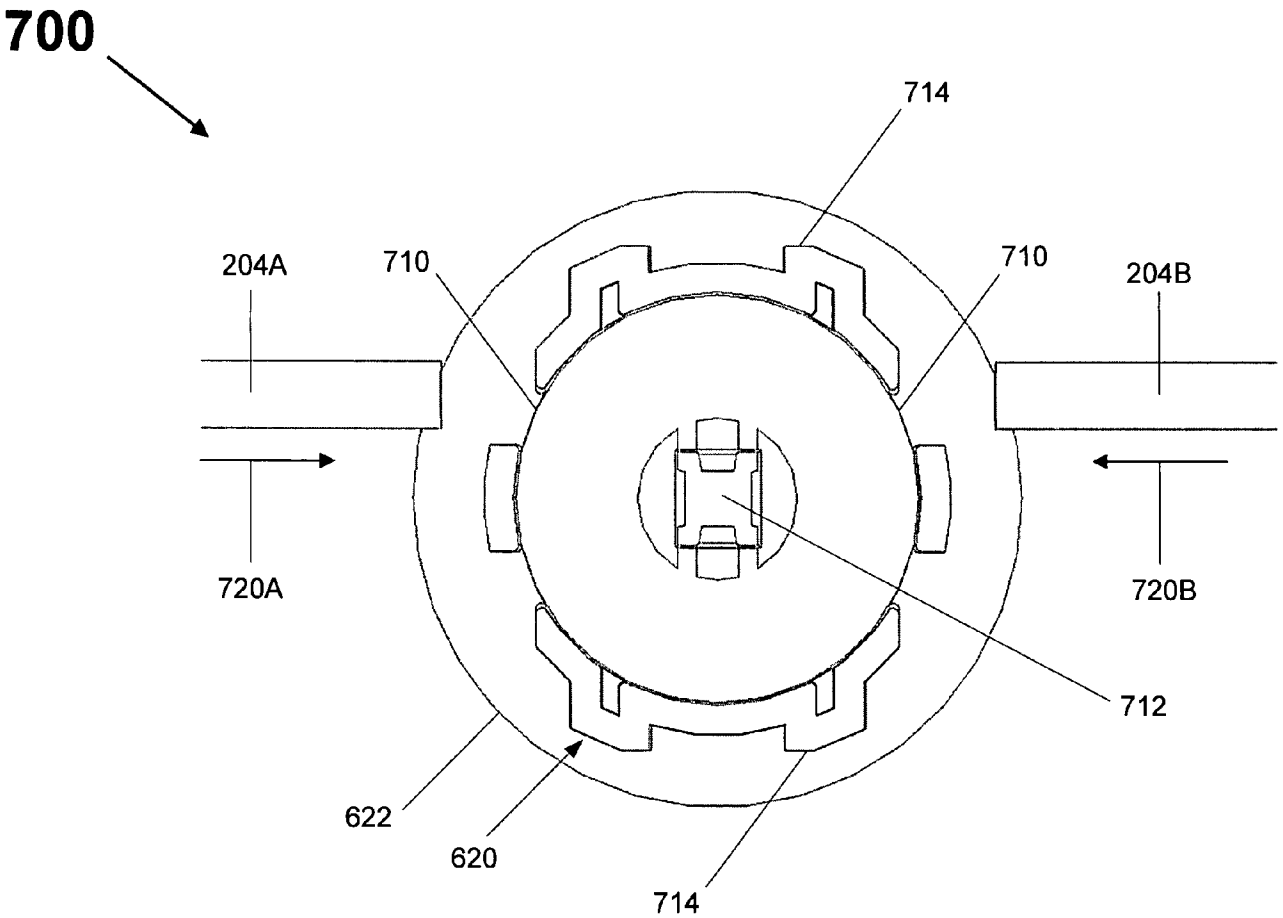
FIG. 7 is a perspective view of the cam portion of the cam lock of the bezel in FIG. 1 in relation to the first rod and second rod when the bezel is unlocked.

FIG. 7 shows the cam portion 620 of the cam lock 206 in relation to the first rod 204A and to the second rod 204B when the bezel 100 is unlocked. The position of the cam portion 620 determines whether the bezel 100 is locked or unlocked. The cam portion 620 alternately rotates between a locked position and an unlocked position. The cam portion 620 has first surface regions 710 that are closer to the center of rotation 712 and second surface regions 714 that are more distant from the center of rotation 712. As explained above, the rods 204 move toward the cam lock 206 when the buttons 114 are pressed. The latch portions 312 also move in the direction that the button portions 310 move, unlatching the bezel 100. The cam portion 620 in FIG. 7 is in an unlocked position since the rods 204 are aligned with the first surface regions 710 and are a sufficient distance from the first surface regions 710 to allow them, along with the button portions 310 and the latch portions 312, to move in the direction of the arrows 720A a sufficient distance to allow the bezel 100 to unlatch.

Figure 8:
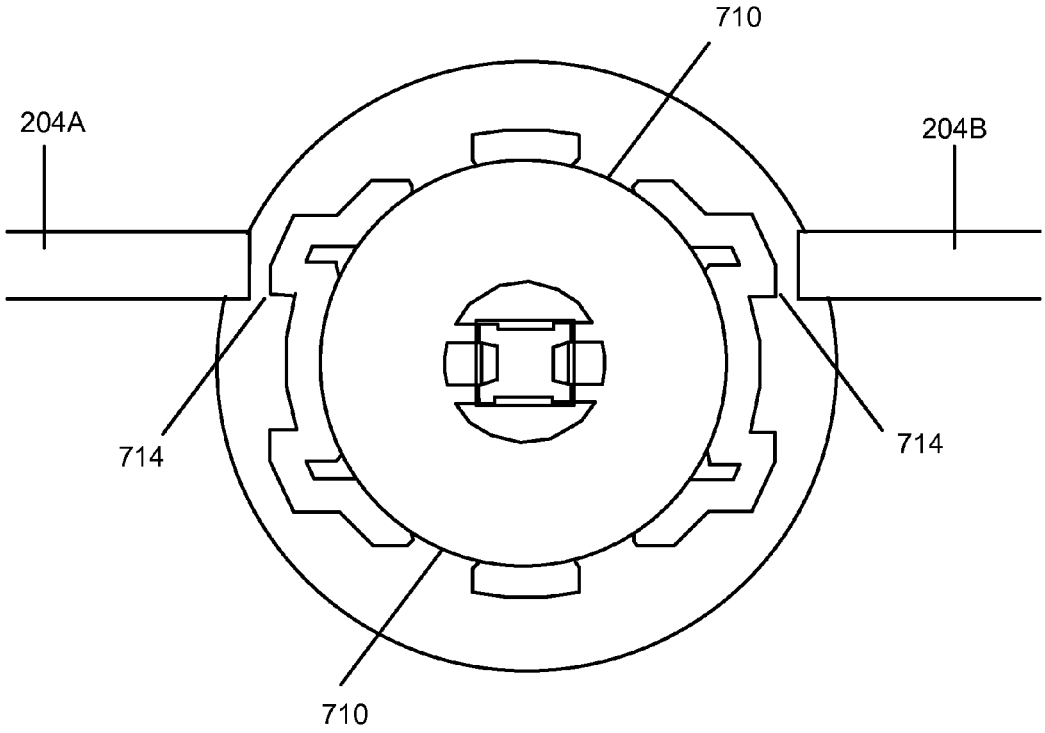
FIG. 8 is a perspective view of the cam portion of the cam lock of the bezel in FIG. 1 in relation to the first rod and second rod when the bezel is locked.

If the cam portion 620, as viewed in FIG. 7, is rotated counterclockwise (clockwise if facing the key port 112) approximately 90 degrees into a locked position, as is shown in FIG. 8, then the rods 204 become aligned with the second surface points 714. In this locked position, the rods 204 are too close to the second surface points 714 and cannot be moved a sufficient distance to allow the latch portions 312 to move sufficiently to unlatch the bezel 100. That is, if the buttons 114 are pressed while the bezel 100 is in a locked position, the rods 204 come in contact with the second surface points 714 before the button portions 310 and latch portions 312 have moved a sufficient distance to allow the broad end of the lip 320A to disengage from the mounting structure. The cam portion 620 is returned to its unlocked position by rotating the cam portion 620 in the reverse direction approximately 90 degrees.

It is a feature of the present invention that the cam lock 206 can be placed almost anywhere between the plunger mechanisms 202 by providing rods 204 of different lengths and making minor changes to the design of the bezel frame 102. For example, FIG. 1 shows the key port 112 of the cam lock 206 positioned near the first button 114A of the first plunger mechanism 202A. FIG. 2 shows that the first rod 204A is correspondingly shorter than the second rod 204B. The cam lock 206 could be repositioned at the center of the bezel frame 102, for example, by using a first rod 204A and a second rod 204B of equal length and redesigning the bezel frame 102 such that the holes 560 are positioned in a more central location, allowing the mounting plate 610 to be attached to the bezel frame 102 in a central location. Similarly, the cam lock 206 could be positioned closer to the second button 114B or equally distant between either of the buttons 114 and the center of the bezel frame 102.

While the present invention has been shown and described herein with reference to specific embodiments thereof, it should be understood by those skilled in the art that variations, alterations, changes in form and detail, and equivalents may be made or conceived of without departing from the spirit and scope of the invention. Accordingly, the scope of the present invention should be assessed as that of the appended claims and by equivalents thereto.

What is claimed is:

1. A bezel comprising:

a bezel frame having a front side and a rear side, the front side having an outer surface with a pair of openings therein, one opening at each of two opposite ends of the bezel frame, the rear side facing an electronics enclosure when the bezel frame is latched thereto;

a first plunger mechanism and a second plunger mechanism moveably coupled to the rear side of the bezel frame at opposite ends of the bezel frame for latching the bezel frame to the electronics enclosure, each plunger mechanism being moveable between latched and unlatched positions, each plunger mechanism comprising a button portion protruding through a respective opening in the front side of the bezel frame, each plunger mechanism being movable toward an interior region of the bezel frame in response to an inward force applied to the button portion of the plunger mechanism, a first rod coupled to the first plunger mechanism and a second rod coupled to the second plunger mechanism, each rod moving toward the interior region at the rear side of the bezel frame when the inward force is applied to the plunger mechanism to which that rod is coupled; and a cam lock positioned between the first rod and the second rod, the cam lock being movable between a locked position and an unlocked position, the cam lock having a cam portion with first surface regions and second surface regions, one end of each rod being aligned with one of the first surface regions when the cam lock is in the unlocked position and with one of the second surface regions when the cam lock is in the locked position, the end of each rod being separated from the surface regions with which that rod is aligned by a gap that determines an extent of distance that the plunger mechanism coupled to that rod is able to travel inwardly when the inward force is applied thereto, wherein, when the cam lock is in the unlocked position, the gap between the first surface regions and the end of each rod has a distance that allows each plunger mechanism to move inwardly to the unlatched position, and when the cam lock is in the locked position, the gap between the second surface regions and the end of each rod is smaller than the distance between the first surface regions and the end of each rod so that the inwardly movement of each plunger mechanism is insufficient for that plunger mechanism to unlatch.

2. The bezel according to claim 1, wherein each plunger mechanism comprises:

a latch portion slidably coupled to the bezel frame; and wherein each button portion is disposed between a respective latch portion and the bezel frame and is coupled to a respective rod.

3. The bezel according to claim 2, wherein the button portion has a receptacle disposed at a periphery thereof for receiving one end of one of the rods.

4. The bezel according to claim 2, wherein the latch portion has a keyed opening receiving a pedestal extending from a back surface of the bezel frame.

5. The bezel according to claim 1, wherein each plunger mechanism comprises a spring mechanism that biases each plunger mechanism toward the latched position.

6. The bezel according to claim 1, wherein each plunger mechanism is securely and moveably coupled to the bezel frame without the use of any separate mechanical hardware fasteners.

7. An electronics equipment enclosure comprising:

a housing with a mounting structure;

a bezel including:

a bezel frame having a front side and a rear side, the front side having an outer surface with a pair of openings therein, one opening at each of two opposite ends of the bezel frame, the rear side facing an electronics enclosure when the bezel frame is latched thereto;

a first plunger mechanism and a second plunger mechanism moveably coupled to the rear side of the bezel frame at opposite ends of the bezel frame for latching the bezel frame to the electronics enclosure, each plunger mechanism being moveable between latched and unlatched positions, each plunger mechanism comprising a button portion protruding through a respective opening in the front side of the bezel frame, each plunger mechanism being movable toward an interior region of the bezel frame in response to an inward force applied to the button portion of the plunger mechanism;

a first rod coupled to the first plunger mechanism and a second rod coupled to the second plunger mechanism, each rod moving toward the interior region at the rear side of the bezel frame when the inward force is applied to the plunger mechanism to which that rod is coupled; and a cam lock positioned between the first rod and the second rod, the cam lock being movable between a locked position and an unlocked position, the cam lock having a cam portion with first surface regions and second surface regions, one end of each rod being aligned with one of the first surface regions when the cam lock is in the unlocked position and with one of the second surface regions when the cam lock is in the locked position, the end of each rod being separated from the surface regions with which that rod is aligned by a gap that determines an extent of distance that the plunger mechanism coupled to that rod is able to travel inwardly when the inward force is applied thereto, wherein, when the cam lock is in the unlocked position, the gap between the first surface regions and the end of each rod has a distance that allows each plunger mechanism to move inwardly to the unlatched position, and when the cam lock is in the locked position, the gap between the second surface regions and the end of each rod is smaller than the distance between the first surface regions and the end of each rod so that the inwardly movement of each plunger mechanism is insufficient for the plunger mechanism to unlatch.

8. The electronics equipment enclosure according to claim 7, wherein each plunger mechanism comprises:

a latch portion slidably coupled to the bezel frame; and wherein each button portion is disposed between a respective latch portion and the bezel frame and is coupled to a respective rod.

9. The electronics equipment enclosure according to claim 8, wherein the button portion has a receptacle disposed at a periphery thereof for receiving one end of one of the rods.

10. The electronics equipment enclosure according to claim 8, wherein the latch portion has a keyed opening receiving a pedestal extending from a back surface of the bezel frame.

11. The electronics equipment enclosure according to claim 7, wherein each plunger mechanism comprises a spring mechanism that biases each plunger mechanism toward the latched position.

12. The electronics equipment enclosure according to claim 7, wherein each plunger mechanism is securely and moveably coupled to the bezel frame without the use of any separate mechanical hardware fasteners.

13. A bezel comprising:

a bezel frame having a front side and a rear side, the front side having an outer surface with a pair of openings therein, one opening at each of two opposite ends of the bezel frame, the rear side facing an electronics enclosure when the bezel frame is latched thereto;

first and second latching means, disposed at opposite ends of the bezel frame, for latching the bezel frame to a mounting structure on the electronics enclosure, each latching means comprising a button portion protruding through a respective opening in the front side of the bezel frame, each latching means being movable toward an interior region of the bezel frame in response to an inward force applied to the button portion;

lock means coupled to the bezel frame at a location between the first and second latching means, the lock means being movable between a locked position and an unlocked position, the lock means having first surface regions and second surface regions;

a first coupling means for coupling the first latching means to the lock means, and a second coupling means for coupling the second latching means to the lock means, each coupling means aligning with one of the first surface regions when the lock means is in the unlocked position and with one of the second surface regions when the lock means is in the locked position, each coupling means being separated from the surface region with which that coupling means is aligned by a gap that determines an extent of distance that the latching means coupled to that coupling means is able to travel inwardly when the inward force is applied thereto;

wherein, when the lock means is in the unlocked position, the gap between the first surface region and the coupling means has a distance that allows each latching means to move inwardly to be unlatched, and when the lock means is in the locked position, the gap between the second surface region and the coupling means is smaller than the distance between the first surface region and the coupling means so that the inwardly movement of each plunger mechanism is insufficient for that plunger mechanism to unlatch.

14. The bezel according to claim 13, wherein each latching means comprises a latch portion slidably coupled to the bezel frame; and wherein each button portion is disposed between a respective latch portion and the bezel frame and is coupled to a respective coupling means.

15. The bezel according to claim 14, wherein each coupling means includes a rod, and wherein the button portion has a receptacle disposed at a periphery thereof for receiving one end of one of the rods.

16. The bezel according to claim 14, wherein the latch portion has a keyed opening receiving a pedestal extending from a back surface of the bezel frame.

17. The bezel according to claim 13, wherein each latching means is securely and moveably coupled to the bezel frame without the use of any separate mechanical hardware fasteners.

18. The bezel according to claim 13, wherein each latching means comprises a spring mechanism that biases each latching means toward the latch position.

* * * * *